United States Patent [19]

Yamamoto et al.

[11] 4,165,724

[45] Aug. 28, 1979

[54] FUEL INJECTION SYSTEM FOR INTERNAL COMBUSTION ENGINE

[75] Inventors: Yoshihisa Yamamoto; Nobuyuki Fujitani, both of Kariya, Japan

[73] Assignee: Nippondenso Co., Ltd., Kariya, Japan

[21] Appl. No.: 794,926

[22] Filed: May 9, 1977

[30] Foreign Application Priority Data

Jul. 1, 1976 [JP] Japan ..... 51-78569

[51] Int. Cl.[2] ..... F02M 39/00

[52] U.S. Cl. ..... 123/139 AT

[58] Field of Search ..... 123/139 AT, 139 AK

[56] References Cited

U.S. PATENT DOCUMENTS

| | | | |
|---|---|---|---|
| 3,810,453 | 5/1974 | Wolfe | 123/139 AT |
| 4,036,192 | 7/1977 | Nakayama | 123/139 AT |
| 4,080,942 | 3/1978 | Vincent et al. | 123/139 AT |

*Primary Examiner*—Charles T. Jordan

*Attorney, Agent, or Firm*—Cushman, Darby & Cushman

[57] ABSTRACT

A fluid pressure chamber is formed in a fuel injection valve, in which a piston connected to a nozzle needle is reciprocally disposed. The pressure chamber is supplied with fluid under pressure from a fluid pump through a check valve. The pressure chamber is also connected with an orifice. When a fuel is distributed from a fuel injection pump under pressure and supplied to the injection valve, the nozzle needle is lifted by the distributed fuel under pressure. When the nozzle needle is lifted, the fluid in the pressure chamber is compressed for causing a fluid pressure applied to the piston in a valve closing direction, whereby the starting of the fuel injection becomes gentle, decreasing combustion noises.

1 Claim, 2 Drawing Figures

FUEL INJECTION SYSTEM FOR INTERNAL COMBUSTION ENGINE

BACKGROUND OF THE INVENTION

The present invention relates to a fuel injection system for an internal combustion engine, especially to a fuel injection valve of a Diesel engine.

In a conventional fuel injection valve of the kind, a nozzle needle is reciprocally moved in a nozzle body having injection ports at the front end of the nozzle body, and thereby the injection ports are opened and closed in accordance with the reciprocal movement of the nozzle needle in order to intermittently inject the fuel. The injection valve is provided with a spring biasing the nozzle needle in a valve closing direction, while the fuel intermittently distributed from a fuel injection pump under high pressure biases the nozzle needle in a valve opening direction, thus the above reciprocal movement of the nozzle needle is performed.

It is recently required for a fuel injection system for an internal combustion engine to decrease a duration of fuel injection as much as possible in view of improving an operational performance of the engine and/or purifying the exhaust gases emitted from the engine. Especially, for the purpose of decreasing combustion noises of the engine, it is desirable for the injection valve to start the fuel injection not rapidly but gently.

In the above conventional fuel injection system, however, the pressure for the fuel distributed from the fuel injection pump to the respective injection valves is increased so as to decrease the duration of the fuel injection, inevitably resulting in a rapid starting of the fuel injection. Because, the nozzle needle reciprocally mounted in the nozzle body is biased toward the valve closing direction by the biasing spring alone. Accordingly, in the conventional fuel injection system, it is disadvantageous that the combustion noises are increased.

SUMMARY OF THE INVENTION

It is, therefore, an object of the present invention to overcome the above drawback and to provide a novel and useful fuel injection valve for an internal combustion engine, which increases engine performance without increasing the combustion noises.

According to one aspect of the present invention, a nozzle needle for opening and closing injection ports of a nozzle body by the reciprocal movement within the nozzle body is biased in a valve closing direction by a fluid pressure when the nozzle needle is lifted in addition to a biasing force of a spring disposed in the injection valve. Thereby a gentle start of a fuel injection from the fuel injection valve is achieved even under a high pressure of the fuel distributed from a fuel injection pump for the purpose of decreasing the duration of the fuel injection.

These objects together with others not specifically mentioned will become clear to those skilled in the art from the following description.

DETAILED DESCRIPTION OF THE PREFERRED EMBODIMENT

Figure 1:
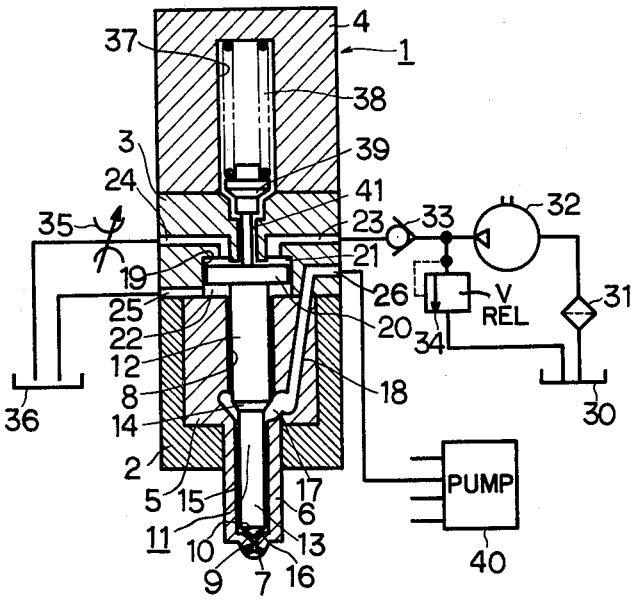
FIG. 1 is a schematic sectional view showing a fuel injection valve of a fuel injection system according to the present invention.

One of the embodiments of the present invention will now be explained with reference to FIG. 1. A fuel injection valve generally designated by numeral 1 comprises lower, intermediate and upper valve casings 2, 3 and 4 which are fixed together by a suitable means (not shown). A nozzle body 5 is mounted in and held by the intermediate and lower casings 3 and 2. A nozzle end 6 of the body 5 protrudes from the lower casing 2 and is formed with an injection port or ports 7. A cylindrical bore 8 is formed in the nozzle body 5 being communicated with the injection ports 7 through a passage 9. At the lower portion of the cylindrical bore 8 is formed a valve seat 10 of a conical configuration.

A nozzle needle generally designated by numeral 11, which is reciprocally mounted within the cylindrical bore 8, comprises an upper section 12 and a lower section 13 connected together at a step portion 14. As seen from the drawing, a diameter of the upper section 12 is larger than that of the lower section 13 and a sufficient space 15 is formed between the inside of the cylindrical bore 8 and the lower section 13 of the nozzle needle 11 for allowing fuel to flow. A valve head 16 is formed at the lower end of the nozzle needle 11 seating on the valve seat 10 for opening and closing the passage 9 and thus the injection ports 7.

A fuel collecting space 17 is also formed in the nozzle body 5 surrounding the step portion 14 of the nozzle needle 11. The space 17 is communicated with a fuel passage 18 formed in the nozzle body 5.

The intermediate casing 3 is formed with a cylindrical bore 19, within which a piston 20 integrally formed with or fixedly secured to the upper end of the nozzle needle 11 is reciprocally disposed, so that a fluid pressure chamber 21 is formed above the piston 20 and a fluid relief chamber 22 is formed below the piston 20.

The casing 3 is also formed with an inlet port 23 communicated with the fluid pressure chamber 21 for supplying fluid, for example a fuel, under pressure from a tank 30 through a filter 31, a fluid pump 32 and a check valve 33. Numeral 34 designates a relief valve for returning the fluid to the tank when the fluid pressure exceeds a predetermined value. An outlet port 24 formed in the casing 3 is communicated with the pressure chamber 21 for passing the fluid from the pressure chamber 21 to a tank 36 through a variable orifice (or a fixed orifice) 35. The orifice 35 controls the fluid flow flowing therethrough. The relief port 25 formed in the casing 3 is communicated with the relief chamber 22 for allowing the fluid to flow from the chamber 22 to the tank 36. The tank 36 may be, of course, the tank 30. A valve inlet 26 also formed in the casing 3 is communicated with the fuel passage 18 for intermittently supplying the fuel under pressure distributed from a fuel injection pump 40 of a known type.

The upper casing 4 is formed with a cylindrical bore 37 for accomodating a compression coil spring 38 and a spring holder 39 connected with the piston 20 by a rod 41. The spring 38 biases the nozzle needle 11 in the valve closing direction in a usual manner.

The mode of operation of the above fuel injection system, especially the fuel injection valve 1 is explained hereinafter.

The fuel from the fuel injection pump 40 is intermittently distributed under a high pressure to the respective injection valves (only one valve is shown in the drawing), and supplied to the fuel collecting space 17. When the force applied to the nozzle needle 11 by the pressurized fuel in the collecting space 17 in a valve opening direction becomes higher than the spring force of the spring 38 in a valve closing direction, the nozzle needle 11 is lifted upwardly to open the injection ports 7, so that the fuel distributed to the injection valve 1 is injected through the injection ports 7. During the above lifting operation of the nozzle needle 11, the fluid pressure is applied to the piston 20 in the valve closing direction by the fluid supplied to the fluid pressure chamber 21.

When the piston 20 is lifted upwardly together with the nozzle needle 11, the fluid in the pressure chamber 21 is subjected to the compression, causing the increase of the fluid pressure applied to the piston 20 in the valve closing direction, whereby the upward movement of the nozzle needle 11 is gently proceeded. The characteristic of the increase of fluid pressure in the pressure chamber 21 is determined by the formation of the orifice 35, and is adjusted to a desired value when the variable orifice is used. When the lifting force applied to the nozzle needle 11 in the valve opening direction becomes the higher, namely when the speed of the upward movement thereof becomes the higher, the larger the fluid pressure applied to the piston 20 in the valve closing direction becomes, whereby the starting characteristic of the fuel injection becomes gentle.

The check valve 33 prevents the fluid from flowing from the pressure chamber 21 to the tank 30.

When the fuel injection terminates and the pressure of the fuel in the fuel collecting space 17 decreases, the nozzle needle 11 is moved downwardly making the valve head 16 to seat on the valve seat 10 to close the injection ports 7. The pressure in the pressure chamber 21 is also decreased in accordance with the downward movement of the piston 20, so that the fluid is again supplied to the chamber 21 from the fluid pump 32 for providing a preparation for the next fuel injection.

Figure 2:
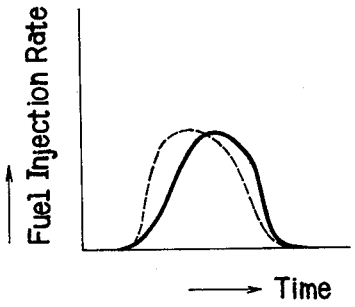
FIG. 2 is a graphical view showing characteristic curves of fuel injection according to the present invention in comparison with that of a conventional one.

FIG. 2 shows characteristic curves of the fuel injection, wherein a solid line is the characteristic curve of the present injection valve while a dotted line is that of the conventional one. As noted from FIG. 2, the starting of the fuel injection according to the present invention is more gentle than that of the conventional injection valve.

It is also noted in the present embodiment that when the nozzle needle is moved in the valve closing direction, fluid pressure at least caused by the fluid pressure in the chamber 21 is applied to the nozzle needle 11 in the valve closing direction in addition to the spring force of the spring 38, whereby the termination of the fuel injection is rapidly proceeded, which also contributes a purification of the exhaust gases.

What is claimed is:

1. A fuel injection system for an internal combustion engine comprising:

fuel injection valves for injecting fuel;

a fuel injection pump for distributing the fuel to the respective fuel injection valves;

a tank for storing fluid;

a fluid pump communicated with said tank for supplying the fluid therefrom under pressure;

said fuel injection valves including, a valve casing formed with an injection port, a nozzle needle reciprocally mounted in said valve casing for opening and closing said injection port by the reciprocal movement of said nozzle needle, a piston connected to said nozzle needle, so that said piston is reciprocated in accordance with the reciprocal movement of said nozzle needle, a fluid pressure chamber formed in said valve casing and communicated with said fluid pump, so that the fluid from said tank is supplied thereto under pressure, said piston being reciprocally disposed in said fluid pressure chamber, so that the fluid pressure is applied to said piston in a valve closing direction, a spring disposed in said valve casing for biasing said nozzle needle in said valve closing direction, and a fuel collecting space formed in said valve casing surrounding at least a portion of said nozzle needle, said space being communicated with said fuel injection pump and also with said injection port when said nozzle needle is lifted, whereby when the fuel is supplied to said fuel collecting space from said fuel injection pump under pressure the pressure in said fuel collecting space biasing said nozzle needle in a valve opening direction;

orifice means communicated with said fluid pressure chamber; and a check valve connected between said fluid pressure chamber and said fluid pump for preventing the fluid from flowing from said fluid pressure chamber to said fluid pump, whereby the fluid pressure is applied to said piston in the valve closing direction when said nozzle needle is lifted, thus performing a gentle starting of the fuel injection.

* * * * *